US009024765B2

(12) United States Patent
Hoesl

(10) Patent No.: US 9,024,765 B2
(45) Date of Patent: May 5, 2015

(54) MANAGING ENVIRONMENTAL CONTROL SYSTEM EFFICIENCY

(75) Inventor: Mark J. Hoesl, Friendswood, TX (US)

(73) Assignee: International Business Machines Corporation, Armonk, NY (US)

( * ) Notice: Subject to any disclaimer, the term of this patent is extended or adjusted under 35 U.S.C. 154(b) by 207 days.

(21) Appl. No.: 13/348,347

(22) Filed: Jan. 11, 2012

(65) Prior Publication Data

US 2013/0176130 A1 Jul. 11, 2013

(51) Int. Cl.
*G08B 17/00* (2006.01)
*F24F 11/00* (2006.01)

(52) U.S. Cl.
CPC ..... *F24F 11/0086* (2013.01); *F24F 2011/0052* (2013.01); *F24F 2011/0071* (2013.01); *F24F 2011/0075* (2013.01)

(58) Field of Classification Search
CPC ..... F24F 11/0086; F24F 2011/0052; F24F 2011/0071; F24F 2011/0075; G05D 23/19; H05K 7/20736
USPC ..... 340/588, 506, 523, 526, 679, 680; 700/276, 278, 108, 174, 32; 236/46 C; 702/182–185; 374/163, 170; 165/108; 454/162; 62/132
See application file for complete search history.

(56) References Cited

U.S. PATENT DOCUMENTS 4,733,225 A * 3/1988 Uematsu et al. ..... 340/584
5,381,669 A 1/1995 Bahel et al.
5,586,445 A 12/1996 Bessler
5,628,201 A 5/1997 Babel et al.
5,860,286 A 1/1999 Tulpule
5,987,903 A 11/1999 Bathla
6,324,854 B1 12/2001 Jayanth
6,385,510 B1 * 5/2002 Hoog et al. ..... 700/276
6,658,373 B2 12/2003 Rossi et al.
6,981,384 B2 1/2006 Dobmeier et al.
7,159,788 B2 1/2007 Eisenhour et al.
2006/0122732 A1 6/2006 Shinomoto et al.
2006/0137368 A1 6/2006 Kang et al.
2006/0137369 A1 6/2006 Galante et al.
2007/0017667 A1 1/2007 Weng
2008/0315000 A1 * 12/2008 Gorthala et al. ..... 236/46
2009/0065595 A1 3/2009 Kates
2010/0102948 A1 * 4/2010 Grohman et al. ..... 340/506
2010/0292860 A1 11/2010 Komiya et al.
2011/0023503 A1 2/2011 Wang et al.

(Continued)

FOREIGN PATENT DOCUMENTS

JP 2010139099 A 6/2010

OTHER PUBLICATIONS

Conant et al, Proctor Engineering Group for Sacramento Municipal Utility District, "Air Conditioner Service Light Project—Final Report", Dec. 2006.

*Primary Examiner* — Benjamin C Lee
*Assistant Examiner* — Chico A Foxx
(74) *Attorney, Agent, or Firm* — Paul S. Drake

(57) ABSTRACT

A method, system or computer usable program product for providing alerts of inefficiency of an environmental conditioning system including, responsive to a cycle initiation by the environmental conditioning system, measuring a difference between an intake temperature and an outlet temperature after a predetermined period of time, and responsive to the difference being below a minimum level, generating an alert.

20 Claims, 5 Drawing Sheets

(56) References Cited

U.S. PATENT DOCUMENTS

2013/0050878 A1* 2/2013 Perez et al. ..... 361/15
2013/0158715 A1* 6/2013 Barton et al. ..... 700/276
2013/0158717 A1* 6/2013 Zywicki et al. ..... 700/276
2013/0158718 A1* 6/2013 Barton et al. ..... 700/276
2013/0158723 A1* 6/2013 Erickson et al. ..... 700/278

* cited by examiner

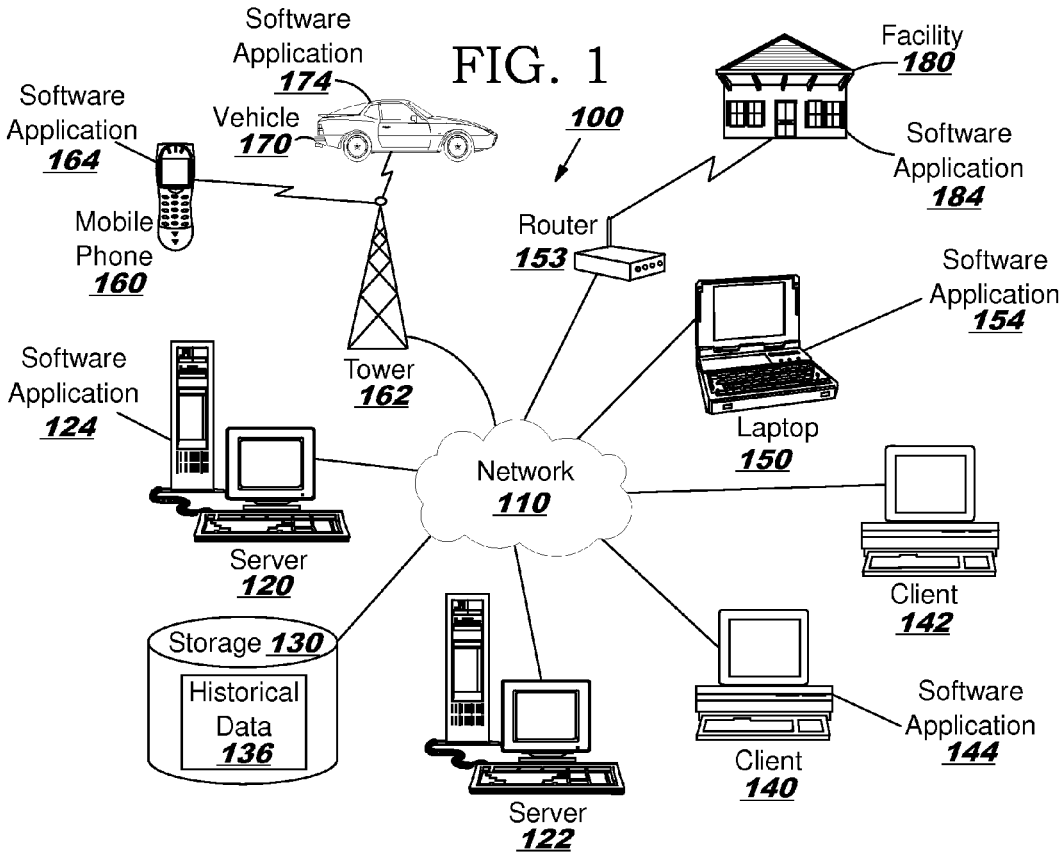
FIG. 2
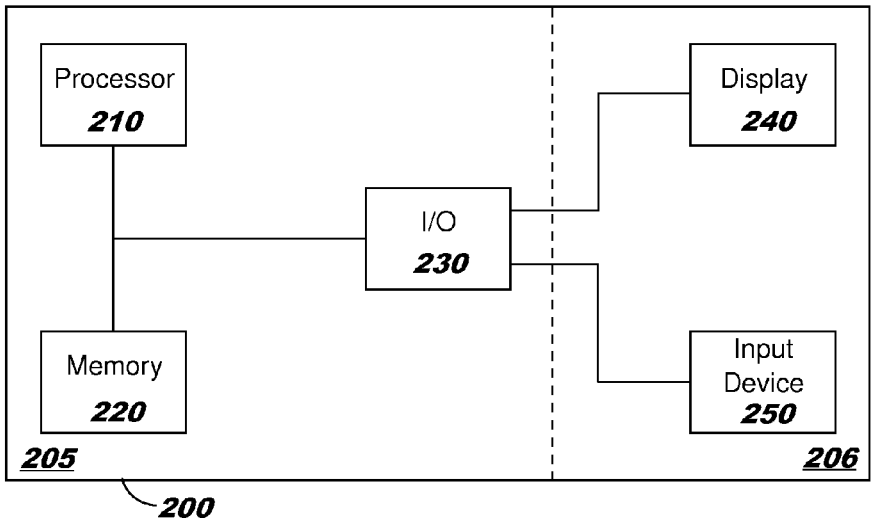

MANAGING ENVIRONMENTAL CONTROL SYSTEM EFFICIENCY

BACKGROUND

1. Technical Field

The present invention relates generally to managing an environmental control system, and in particular, to a computer implemented method for managing efficiency for an environmental control system.

2. Description of Related Art

One of the earliest needs of man for comfort was heating and air conditioning. Heating was created when man learned to control fire. Air conditioning was obtained by living in caves. Since those early years, man has sought these comforts throughout the world, often at great expense.

Today we have reliable energy sources such as electricity, gas and fuel oil for powering heating and air conditioning, although the cost of those energy sources keeps rising. In addition, modern heating and air conditioning systems are designed to be highly reliable and will continue performing even when they require maintenance. As a result, these comforts are often taken for granted and may run inefficiently without that inefficiency being noticed by the user, thereby wasting costly energy. For example, heating and air conditioning systems occasionally require maintenance due to dirty filters, low refrigerant, lack of engine lubrication, etc. Running an air conditioner or heater in these conditions reduces efficiency and increases the likelihood of system failure, often at the most inopportune times when the system is most stressed.

SUMMARY

The illustrative embodiments provide a method, system, and computer usable program product for providing alerts of inefficiency of an environmental conditioning system including, responsive to a cycle initiation by the environmental conditioning system, measuring a difference between an intake temperature and an outlet temperature after a predetermined period of time, and responsive to the difference being below a minimum level, generating an alert.

BRIEF DESCRIPTION OF THE SEVERAL VIEWS OF THE DRAWINGS

The novel features believed characteristic of the invention are set forth in the appended claims. The invention itself, further objectives and advantages thereof, as well as a preferred mode of use, will best be understood by reference to the following detailed description of illustrative embodiments when read in conjunction with the accompanying drawings, wherein:

FIG. 1 depicts a block diagram of a network of data processing systems in which various embodiments may be implemented;

FIG. 2 depicts a block diagram of a data processing system in which various embodiments may be implemented;

DETAILED DESCRIPTION

Figure 3:
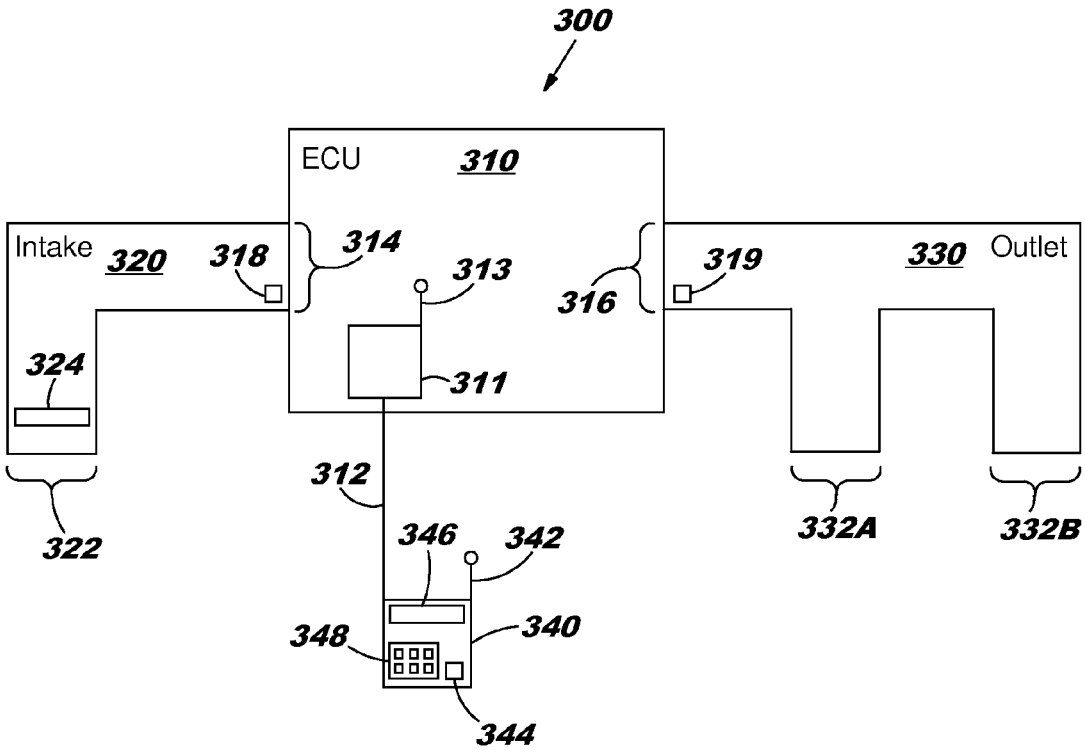
FIG. 3 depicts a block diagram of an environmental control system in accordance with a first embodiment.

Steps may be taken to manage the maintenance of an environmental control system. These steps may be taken as will be explained with reference to the various embodiments below.

FIG. 1 depicts a pictorial representation of a network of data processing systems in which various embodiments may be implemented. Data processing environment 100 is a network of data processing systems also known as computers or computer devices in which the embodiments may be implemented. Software applications may execute on any computer or other type of data processing system in data processing environment 100. Data processing environment 100 includes network 110. Network 110 is the medium used to provide communications links between various devices and computers connected together within data processing environment 100. Network 110 may include connections such as wire, wireless communication links, or fiber optic cables.

Servers 120 and 122 and clients 140 and 142 are coupled to network 110 along with storage unit 130. In addition, laptop 150 and facility 180 (such as a home or business) are coupled to network 110 including wirelessly such as through a network router 153. A mobile phone 160 and vehicle 170 are also coupled to network 110 through a mobile phone tower 162. Data processing systems, such as server 120 and 122, client 140 and 142, laptop 150, mobile phone 160, vehicle 170, facility 180 contain data and have software applications including software tools executing thereon. Other types of data processing systems such as personal digital assistants (PDAs), smartphones, tablets and netbooks may be coupled to network 110.

Server 120 may include software application 124 such as for managing an environmental control system for the various computer devices or other software applications in accordance with embodiments described herein. Storage 130 may contain a content source such historical data for an environmental control system or other content for sharing among various computer or other data processing devices. Client 140 may include software application 144. Laptop 150 and mobile phone 160 may also include software applications 154 and 164. Vehicle 170 and facility 180 may include software applications 174 and 184. Other types of data processing systems coupled to network 110 may also include software applications. Software applications could include a web browser, email, or other software application that can process sensor and maintenance information of an environmental control unit or other type of information to be processed.

Servers 120 and 122, storage unit 130, clients 140 and 142, laptop 150, mobile phone 160, vehicle 170 and facility 180 and other data processing devices may couple to network 102 using wired connections, wireless communication protocols, or other suitable data connectivity. Clients 140 and 142 may be, for example, personal computers or network computers.

In the depicted example, server 120 may provide data, such as boot files, operating system images, and applications to clients 140 and 142 and laptop 150. Clients 140 and 142 and laptop 150 may be clients to server 120 in this example. Clients 140 and 142, laptop 150, mobile phone 160, vehicle 170 and facility 180 or some combination thereof, may include their own data, boot files, operating system images, and applications. Data processing environment 100 may include additional servers, clients, and other devices that are not shown.

In the depicted example, data processing environment 100 may be the Internet. Network 110 may represent a collection of networks and gateways that use the Transmission Control Protocol/Internet Protocol (TCP/IP) and other protocols to communicate with one another. At the heart of the Internet is a backbone of data communication links between major nodes or host computers, including thousands of commercial, governmental, educational, and other computer systems that route data and messages. Of course, data processing environment 100 also may be implemented as a number of different types of networks, such as for example, an intranet, a local area network (LAN), or a wide area network (WAN). FIG. 1 is intended as an example, and not as an architectural limitation for the different illustrative embodiments.

Among other uses, data processing environment 100 may be used for implementing a client server environment in which the embodiments may be implemented. A client server environment enables software applications and data to be distributed across a network such that an application functions by using the interactivity between a client data processing system and a server data processing system. Data processing environment 100 may also employ a service oriented architecture where interoperable software components distributed across a network may be packaged together as coherent business applications.

FIG. 2 depicts a block diagram of a data processing system in which various embodiments may be implemented. Data processing system 200 is an example of a computer device, such as server 120, client 140, laptop 150, mobile phone 160, vehicle 170 or facility 180 in FIG. 1, in which computer usable program code or instructions implementing the processes may be located for the illustrative embodiments.

In the depicted example, data processing system 200 includes a CPU or central processing unit 210 which may contain one or more processors and may be implemented using one or more heterogeneous processor systems including a graphics processor. The depicted example also includes a memory 220 which may be used for storing instructions and data to be processed by CPU 210. Memory 220 may include a main memory composed of random access memory (RAM), read only memory (ROM), or other types of storage devices. Memory 210 could also include secondary storage devices such as a hard disk drive, DVD drive or other devices which may be internal or external to data processing system 200. An input output device (I/O) 230 is also shown in the depicted example for managing communications with various input devices and output devices. However, other examples could use the CPU to communicate directly with various input or output devices or use separate input and output controllers.

In the depicted example, a computer display 240 is shown for the data processing system to communicate with a user or another data processing system. Other types of output devices may be used such as an audio device. An input device 250 is also shown which may be a keyboard, mouse, a touch sensitive display, or other types of input devices.

Data processing system 200 is shown with an internal section 205 and an external section 206. Often input and output devices may be physically separate from but connected to the CPU and memory. However, that is often not the case with portable devices such as mobile phones.

An operating system may run on processor 210. The operating system coordinates and provides control of various components within data processing system 200 in FIG. 2. The operating system may be a commercially available operating system. An object oriented programming system may run in conjunction with the operating system and provides calls to the operating system from programs or applications executing on data processing system 200. Instructions for the operating system, the object-oriented programming system, and applications or programs may be located on secondary storage devices such a hard drive, and may be loaded into RAM for execution by processing unit 210.

The hardware in FIGS. 1-2 may vary depending on the implementation. Other internal hardware or peripheral devices, such as flash memory, equivalent non-volatile memory, or optical disk drives and the like, may be used in addition to or in place of the hardware depicted in FIGS. 1 and 2. In addition, the processes of the embodiments may be applied to a multiprocessor data processing system.

The depicted examples in FIGS. 1-2 and above-described examples are not meant to imply architectural limitations. For example, data processing system 200 may also be a mobile phone 160, tablet computer, laptop computer, or telephone device.

FIG. 3 depicts a block diagram of an environmental control system 300 in accordance with a first embodiment. This embodiment may be implemented within an environmental control unit from the factory. Environmental control system 300 includes an environmental control unit 310, an air intake plenum 320, an air outlet plenum 330 and an external control unit 340. As described above, an environmental control unit may include and air conditioning unit, a heating unit, or both. If both, it is often referred to as a HVAC (heating, ventilation and air conditioning). The operation of environmental control system 300 is described below with reference to FIG. 4.

Environmental control unit 310 includes an internal control unit 311 which coupled to an external control unit 340. Control units 311 and 340 may be coupled by wire 312 or wirelessly using antennas 313 and 342. Environmental control unit also contains an intake 314 and an outlet 316. Air is drawn into intake 314 through intake plenum 320 such as by using a fan. The temperature of the air may be modified (cooled or heated) by environmental control unit 310. The outlet air is then pushed, possibly by the same or a different fan, through outlet 316 and outlet plenum 330.

Environmental control unit 310 includes a temperature sensor 318 at intake 314 and a temperature sensor 319 at outlet 316. The temperature sensors may be installed just inside intake plenum 320 and outlet plenum 340 or the temperature sensors may be located just inside intake 314 and outlet 316, possibly on the lip of the intake and outlet. In an air conditioning only configuration that doesn't need to monitor plenum issues, the temperature sensors can be mounted adjacent to the intake and outlet lines of the condenser coil. If the intake mixes enclosed air with outside air, an intake temperature sensor is preferably placed upstream of where the air is mixed to determine the temperature of the air actually being heated or cooled. These temperature sensors may be installed at the factory, during installation at a home, business or vehicle, or at any time after installation. In addition, the temperature sensors can be temporarily installed in a portable form as a HVAC diagnostic tool. These temperature sensors may be coupled to control unit 311 through wires or even wirelessly. If wired, the wiring could include wires for providing power to the sensors for sensing and communicating with control unit 311. If wireless, then the sensors may include replaceable or rechargeable batteries for providing power. The sensors may also include a fan or other means for generating power to recharge the sensor batteries.

Intake plenum 320 includes an intake grill 322 for obtaining air from an enclosed space such as a home, business or vehicle for the purpose of conditioning that air such as by cooling. Intake grill 322 may also obtain air from outside the enclosed space or use some combination of inside and outside air for improving ventilation. Although a single intake grill is shown, multiple intake grills may also be utilized such as one intake for obtaining enclosed air and one intake for obtaining outside air. Also included is a filter 324 for removing particles from intake air. Outlet plenum 330 may include one or more outlet vents 332A and 332B, collectively referred to herein as outlet vent 332, for providing conditioned air to an enclosed space such as a home, business or vehicle.

External control unit 340 may include antenna 342, a processing unit 344, a display 346 and a keyboard 348. External control unit 340 may be located in the enclosed space being cooled or heated or may be located remotely such as a control room for multiple such environmental control units.

Figure 4:
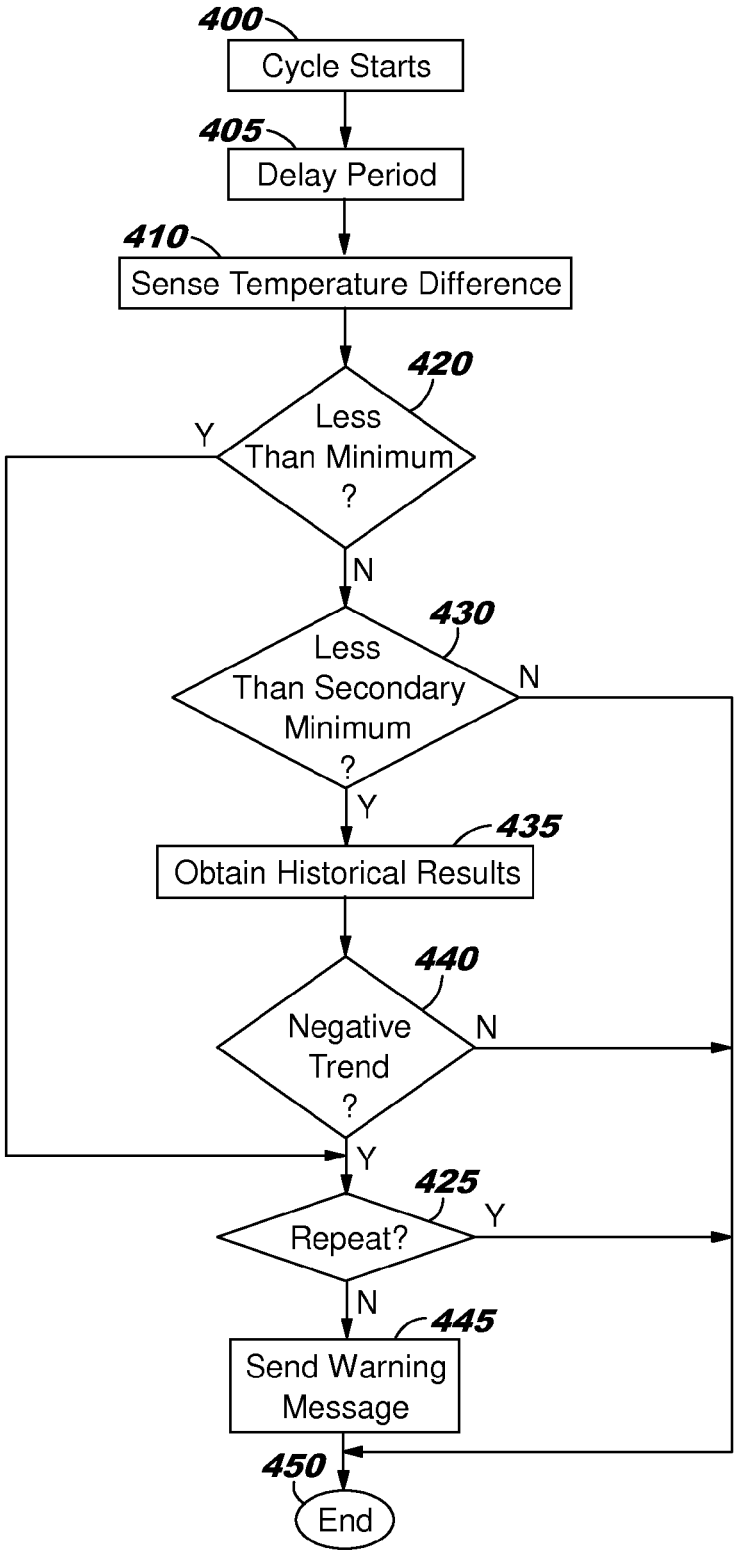
FIG. 4 depicts a flow diagram of the operation of an environmental control system in accordance with a first embodiment.

FIG. 4 depicts a flow diagram of the operation of environmental control system 300 in accordance with a first embodiment. This process may be implemented by internal control unit 311, although it may also be implemented by the external control unit or other processing units in communication with the temperature sensors.

In a first step 400, the system determines that a cycle for cooling or heating air has started. This can be determined by internal control unit 311 or external control unit 340 such as when a command is sent to the environmental control unit 310 to start a cooling or heating cycle. The outlet temperature sensor may also detect this when there is a sudden change in temperature. Other sensors may be used to determine when this step occurs. Once a new cycle has been detected, a delay period occurs in step 405 to allow the system to reach an efficient state before proceeding. As a result, the temperature difference between the intake and outlet may be less than desired initially, yet be expected and normal. This period of time may be a set period of time that was provided at the factory. This period of time may be modified over time based on the age of the environmental control unit or other factors such as historical information such a prior temperature sensor results. However, it is preferred that the period of time be predetermined before the initiation of the cycle being measured.

In step 410, the temperature of the intake air is measured by sensor 318 and the temperature of the outlet air is measured by sensor 319. These measurements may be stored in memory for future use as described below. The difference of these temperatures is then determined. If the system being sensed is an HVAC system with both heating and air conditioning, the temperature difference needs to be evaluated based on which system is running. This may be accomplished by obtaining a signal from internal control unit 311 or external control unit 340. In the alternative, this may be determined by simply determining whether the outlet air is warmer or cooler than the intake air. If warmer, then the heater is running and if cooler, then the air conditioner is running.

In step 420, it is determined whether this difference is less than a minimum amount. This minimum amount may be established at the factory or may be entered or modified by the installer or a user such as by using keypad 348. In the case of cooling, a normal expected temperature difference may be about fifteen degrees Fahrenheit, so the minimum may be set for about twelve or thirteen degrees Fahrenheit. In the case of heating, a normal expected temperature difference may be about twenty degrees Fahrenheit, so the minimum may be set for about seventeen or eighteen degrees Fahrenheit.

Various issues may cause temperature differences to be less than desired. For example, filter 324 may be dirty and preventing enough air to pass through the environmental conditioning unit to allow it to function efficiently. As a result, just cleaning or replacing the air filter may substantially improve performance. In addition, the Freon of a cooling unit may be low or the heating coils of a heating unit may be dirty, also creating poor efficiencies that need to be addressed such as by a service technician.

If the temperature difference is less than the minimum, then a warning condition has occurred and processing continues to step 425. In step 425 it is determined whether this condition is being repeated and has occurred recently such as since the last system maintenance or within the past week. If yes, then a repeated alert or warning every cycle may not be desired, so processing continues to step 450 where processing ceases for this cycle of the environmental conditioning system. If not a repeat condition, then processing continues to step 445 where an alert or warning message is generated. This alert may be displayed on display 348 and/or it may be sent to a technician across the internet or other communication means such as by cellular phone. In each case, the alert is to inform the individual responsible for the performance of the environmental control unit that there is an efficiency issue. Processing then processed to step 450 where processing ceases for this cycle of the environmental control unit. If the temperature difference is above the minimum, then processing continues to step 430. In the alternative, processing may simply proceed to step 450.

In step 430, it is determined whether the temperature difference indicates system maintenance may be desirable. That is, the temperature difference is greater than the minimum, but less than a secondary minimum. If not, then processing continues to step 450. If yes, then this temperature difference may be reviewed in light of historical data in step 435. In step 435, historical data is obtained and examined in light of the latest temperature difference to determine if certain trends have developed. In step 440, it is determined whether a statistically significant negative trend has been occurring. If not, then processing continues to step 450 as before. If yes, then there may be a long term trend of losing efficiency so processing continues to step 425 where it is determined if this is a repeat warning. If not, then an alert or warning message is generated in step 445. This alert may be identical to the warning message described above. However, a different type of warning message may be provided that shows that a long term trend of loss of efficiency may have occurred, but it has not crossed the minimum temperature difference yet. This may be viewed by the recipient as an indication of maintenance needed soon if not already scheduled. However, this alert is less severe as there has not been a large loss of efficiency yet.

Figure 5:
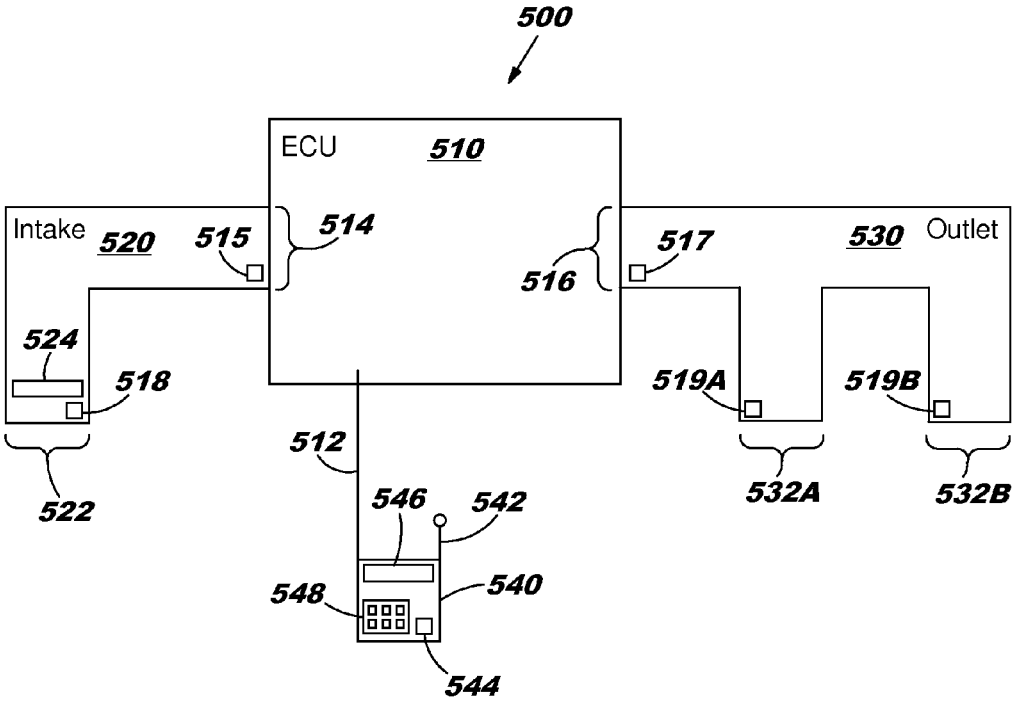
FIG. 5 depicts a block diagram of an environmental control system in accordance with a second embodiment.

FIG. 5 depicts a block diagram of an environmental control system 500 in accordance with a second embodiment. This embodiment may be implemented within an environmental control unit during or after installation at a home, business or vehicle. Environmental control system 500 includes an environmental control unit 510, an air intake plenum 520, an air outlet plenum 530 and an external control unit 540. As described above, an environmental control unit may include and air conditioning unit, a heating unit, or both. If both, it is often referred to as a HVAC (heating, ventilation and air conditioning). The operation of environmental control system 500 is described below with reference to FIG. 6.

Environmental control unit 510 may be coupled to an external control unit 540 by wire 512 or wirelessly to external control unit antenna 542. Environmental control unit contains an intake 514 and an outlet 516. Air is drawn into intake 514 through intake plenum 520 such as by using a fan. The temperature of the air may be modified (cooled or heated) by environmental control unit 510. The outlet air is then pushed, possibly by the same or a different fan, through outlet 516 and outlet plenum 530.

Intake plenum 520 includes an intake grill 522 for obtaining air from an enclosed space such as a home, business or vehicle for the purpose of conditioning that air such as by cooling. Intake grill 522 may also obtain air from outside the enclosed space or use some combination of inside and outside air for improving ventilation. Although a single intake grill is shown, multiple intake grills may also be utilized such as one intake for obtaining enclosed air and one intake for obtaining outside air. Also included is a filter 524 for removing particles from intake air. Outlet plenum 530 may include one or more outlet vents 532A and 532B, collectively referred to herein as outlet vent 532, for providing conditioned air to an enclosed space such as a home, business or vehicle.

Environmental control system 500 may also include a temperature sensor 518 at intake grill 522, either before or after filter 524. If the intake mixes enclosed air with outside air, an intake temperature sensor is preferably placed upstream of where the air is mixed to determine the temperature of the air actually being heated or cooled. Environmental control system 500 may also include outlet temperature sensors 519A and 519B, collectively referred to at temperature sensor 519, at outlet vents 532*a* and 532B. Although multiple temperature sensors are shown at multiple outlet vents, a single temperature sensor may be used at each outlet vent. Additional temperature sensors 515 and 517 may be placed at intake 514 and outlet 516 respectively.

Each of these temperature sensors may be installed when the environmental conditioning unit is installed or they may be installed post installation such as by the owner or by a service technician doing diagnostics on the unit. These temperature sensors may be couple to control unit 540 through wires or even wirelessly. If wired, the wiring could include wires for providing power to the sensors for sensing and communicating with control unit 540. If wireless, then the sensors may include replaceable or rechargeable batteries for providing power. The sensors may also include a fan or other means for generating power to recharge the sensor batteries.

External control unit 540 includes antenna 542, a processing unit 544, a display 546 and a keyboard 548. External control unit 540 may be located in the enclosed space being cooled or heated or may be located remotely such as a control room for multiple such environmental control units.

Figure 6:
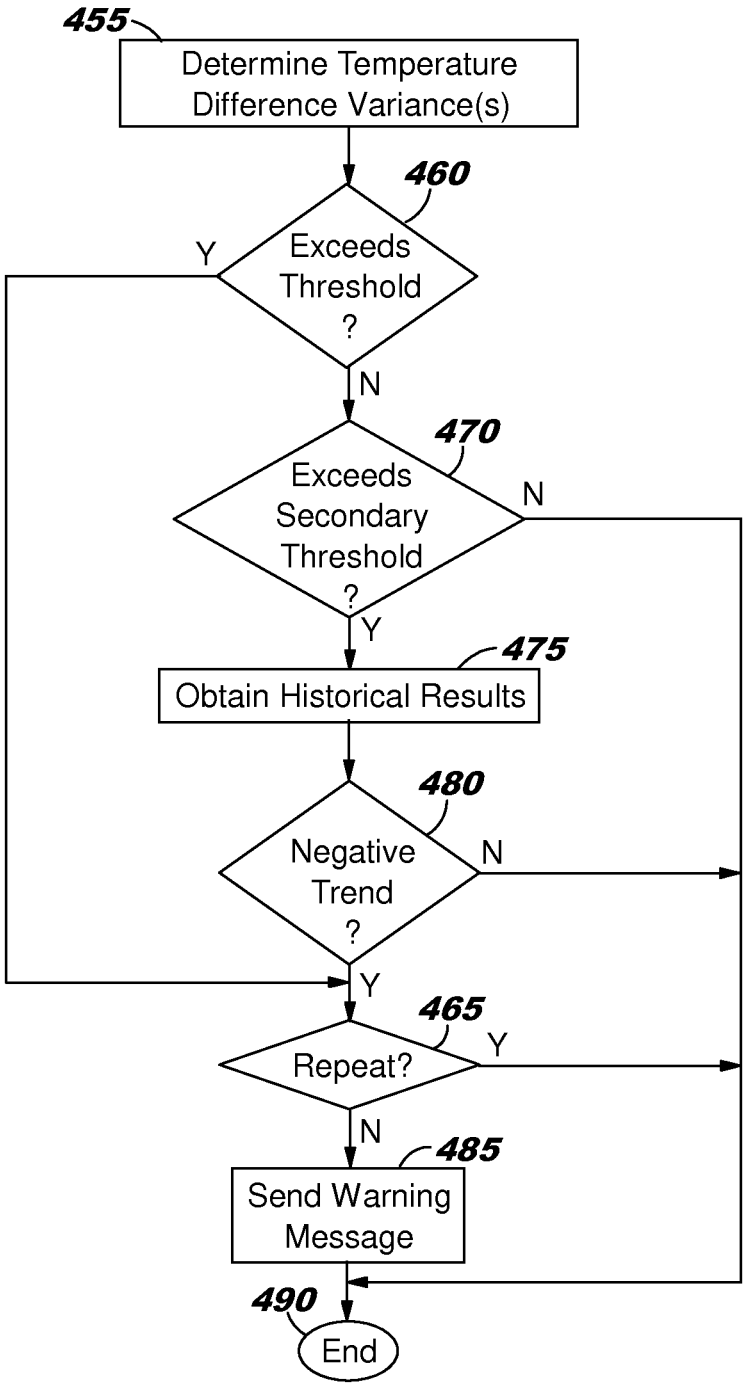
FIG. 6 depicts a flow diagram of the operation of an environmental control system in accordance with a second embodiment.

FIG. 6 depicts a flow diagram of the operation of environmental control system 500 in accordance with a second embodiment. The initial steps of the operation of the second embodiment are generally shown and described in FIG. 4 above. Given there are multiple intake temperature sensors 514 and 518 and multiple outlet temperature sensors 532A and 532B in the second embodiment, the process steps of FIG. 4 may be performed for each pair of intake and outlet sensors or an average of the intake and outlet sensors may be used in the temperature difference calculations. Regardless, FIG. 6 may be performed in lieu of step 450 of FIG. 4.

In step 455, a variance is calculated between intake temperature sensors 515 and 518 and variances are calculated between outlet temperature sensors 517, 519A and 519B. In step 460, it is determined whether any of those variances is greater than an allowable threshold amount. This threshold amount may be established at the factory or may be entered or modified by the installer or a user such as by using keypad 348. In the case of cooling or heating, the variance should be near zero, so the allowable threshold amount may be set as low as 1 degree Fahrenheit or even less. Various issues may cause temperature differences to be greater than expected. For example, plenum 530 may have a leak in an area between the outlet sensors. In addition, various baffles or other obstructions may by limiting the amount of air passing by one of the outlet sensors more than desired. As a result, repairing or taping a plenum, opening a baffle, or cleaning out obstructions may substantially improve performance. However, if there is a desired variance due to factors such as intended baffling (for example, the north side of a facility may not need as much cooling so less cool air is desired to that location), the threshold amount for a given variance may be set at a higher level.

If any temperature variance is greater than the threshold amount, then a warning condition has occurred and processing continues to step 465. In step 465 it is determined whether this condition is being repeated and has occurred recently such as since the last system maintenance or within the past week. If yes, then a repeated alert or warning every cycle may not be desired, so processing continues to step 490 where processing ceases for this cycle of the environmental conditioning system. If not a repeat condition, then processing continues to step 485 where an alert or warning message is generated. This warning message may be displayed on display 348 and/or it may be sent to a technician across the internet or other communication means such as by cellular phone. In each case, the warning message is to inform the individual responsible for the performance of the environmental control unit that there may be an efficiency and maintenance issue. Processing then processed to step 490 where processing ceases for this cycle of the environmental control unit. If all of the temperature variances less than the threshold, then processing may continue to step 470. In the alternative, processing may simply proceed to step 490.

In step 470, it is determined whether any of the variances indicate system maintenance may be desirable. That is, the temperature variances are less than a variance threshold, but greater than a desired secondary variance threshold. If not, then processing continues to step 490. If yes, then this temperature variance may need to be reviewed in light of historical data in step 475. In step 475, historical data is obtained and examined in light of the latest temperature variances to determine if certain trends have developed. In step 480, it is determined whether a statistically significant negative trend has been occurring. If not, then processing continues to step 490 as before. If yes, then there may be a long term trend of losing efficiency so processing continues to step 465 where it is determined if this is a repeat warning. If not, then an alert or warning message is generated in step 485. This alert may be identical to the warning message described above. However, a different type of warning message may be provided that shows that a long term trend of loss of efficiency may have occurred, but it has not crossed the minimum temperature threshold yet. This may be viewed by the recipient as an indication of maintenance needed soon if not already scheduled. However, this alert is less severe as there has not been a large loss of efficiency yet.

The invention can take the form of an entirely software embodiment, or an embodiment containing both hardware and software elements. In a preferred embodiment, the invention is implemented in software or program code, which includes but is not limited to firmware, resident software, and microcode.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM), or Flash memory, an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing. Further, a computer storage medium may contain or store a computer-readable program code such that when the computer-readable program code is executed on a computer, the execution of this computer-readable program code causes the computer to transmit another computer-readable program code over a communications link. This communications link may use a medium that is, for example without limitation, physical or wireless.

A data processing system suitable for storing and/or executing program code will include at least one processor coupled directly or indirectly to memory elements through a system bus. The memory elements can include local memory employed during actual execution of the program code, bulk storage media, and cache memories, which provide temporary storage of at least some program code in order to reduce the number of times code must be retrieved from bulk storage media during execution.

A data processing system may act as a server data processing system or a client data processing system. Server and client data processing systems may include data storage media that are computer usable, such as being computer readable. A data storage medium associated with a server data processing system may contain computer usable code such as web conference applications or plug-ins. A client data processing system may download that computer usable code, such as for storing on a data storage medium associated with the client data processing system, or for using in the client data processing system. The server data processing system may similarly upload computer usable code from the client data processing system such as a content source. The computer usable code resulting from a computer usable program product embodiment of the illustrative embodiments may be uploaded or downloaded using server and client data processing systems in this manner.

Input/output or I/O devices (including but not limited to keyboards, displays, pointing devices, etc.) can be coupled to the system either directly or through intervening I/O controllers.

Network adapters may also be coupled to the system to enable the data processing system to become coupled to other data processing systems or remote printers or storage devices through intervening private or public networks. Modems, cable modem and Ethernet cards are just a few of the currently available types of network adapters.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to explain the principles of the invention, the practical application, and to enable others of ordinary skill in the art to understand the invention for various embodiments with various modifications as are suited to the particular use contemplated.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A method for providing alerts of inefficiency of an environmental conditioning system comprising:

responsive to a cycle initiation by the environmental conditioning system, measuring a first difference between an intake temperature and an outlet temperature after a predetermined period of time and measuring an outlet temperature difference between multiple outlet locations of the environmental conditioning system; and determining whether the first difference is below a primary minimum level;

determining whether the first difference is above the primary minimum level and below a secondary minimum level and exhibits a negative trend according to historical information of the environmental conditioning system;

responsive to a positive determination, generating a user alert; and responsive to determining whether the outlet temperature difference is above a threshold, generating an alert.

2. The method of claim 1 wherein the historical information includes prior intake and outlet temperature differences.

3. The method of claim 2 wherein a statistically significant decrease in the prior intake and outlet temperature differences over time indicates a negative trend.

4. The method of claim 1 further comprising responsive to the outlet temperature difference being below a threshold and above a secondary threshold, obtaining historical information of the environmental conditioning system.

5. The method of claim 4 further comprising responsive to the outlet temperature difference in combination with the historical information indicating a statistically significant negative trend, generating the alert.

6. The method of claim 1 wherein the alert is displayed on a home monitoring system.

7. The method of claim 1 wherein the alert is sent to a service technician via the Internet.

8. A computer usable program product comprising a non-transitory computer usable storage medium including computer usable code for providing alerts of inefficiency of an environmental conditioning system, the computer usable program product comprising the computer usable code for performing the steps of:

responsive to a cycle initiation by the environmental conditioning system, measuring a first difference between an intake temperature and an outlet temperature after a predetermined period of time and measuring an outlet temperature difference between multiple outlet locations of the environmental conditioning system; and determining whether the first difference is below a primary minimum level;

determining whether the first difference is above the primary minimum level and below a secondary minimum level and exhibits a negative trend according to historical information of the environmental conditioning system;

responsive to a positive determination, generating a user alert; and responsive to determining whether the outlet temperature difference is above a threshold, generating an alert.

9. The computer usable program product of claim 8 wherein the historical information includes prior intake and outlet temperature differences.

10. The computer usable program product of claim 9 wherein a statistically significant decrease in the prior intake and outlet temperature differences over time indicates a negative trend.

11. The computer usable program product of claim 8 further comprising responsive to the outlet temperature difference being below a threshold and above a secondary threshold, obtaining historical information of the environmental conditioning system.

12. The computer usable program product of claim 11 further comprising responsive to the outlet temperature difference in combination with the historical information indicating a statistically significant negative trend, generating the alert.

13. The computer usable program product of claim 8 further comprising the computer usable code for performing the step of responsive to the outlet temperature difference being below a threshold and above a secondary threshold, obtaining historical information of the environmental conditioning system.

14. The computer usable program product of claim 13 further comprising the computer usable code for performing the step of responsive to the outlet temperature difference in combination with the historical information indicating a statistically significant negative trend, generating the alert.

15. A data processing system for anticipating parking space availability, the data processing system comprising: a processor; and a memory storing program instructions which when executed by the processor execute the steps of:

responsive to a cycle initiation by the environmental conditioning system, measuring a first difference between an intake temperature and an outlet temperature after a predetermined period of time and measuring an outlet temperature difference between multiple outlet locations of the environmental conditioning system; and determining whether the first difference is below a primary minimum level;

determining whether the first difference is above the primary minimum level and below a secondary minimum level and exhibits a negative trend according to historical information of the environmental conditioning system;

responsive to a positive determination, generating a user alert; and responsive to determining whether the outlet temperature difference is above a threshold, generating an alert.

16. The data processing system of claim 15 wherein the historical information includes prior intake and outlet temperature differences.

17. The data processing system of claim 16 wherein a statistically significant decrease in the prior intake and outlet temperature differences over time indicates a negative trend.

18. The data processing system of claim 15 further comprising responsive to the outlet temperature difference being below a threshold and above a secondary threshold, obtaining historical information of the environmental conditioning system.

19. The data processing system of claim 18 further comprising responsive to the outlet temperature difference in combination with the historical information indicating a statistically significant negative trend, generating the alert.

20. The data processing system of claim 15 wherein the alert is displayed on a home monitoring system.

* * * * *